US007779641B2

(12) United States Patent
Lee et al.

(10) Patent No.: US 7,779,641 B2
(45) Date of Patent: Aug. 24, 2010

(54) ICE SUPPLIER

(75) Inventors: Dong Hoon Lee, Seoul (KR); Wook Yong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 227 days.

(21) Appl. No.: 11/951,406

(22) Filed: Dec. 6, 2007

(65) Prior Publication Data

US 2008/0157644 A1 Jul. 3, 2008

(30) Foreign Application Priority Data

Dec. 29, 2006 (KR) ..... 10-2006-0137659

(51) Int. Cl.

| | |
|---|---|
| ***F25C 1/00*** | (2006.01) |
| ***F25C 5/18*** | (2006.01) |
| ***F25D 17/00*** | (2006.01) |
| ***B67D 7/22*** | (2010.01) |

(52) U.S. Cl. ..... 62/137; 62/59; 62/344; 222/64

(58) Field of Classification Search ..... 62/137, 62/344, 59

See application file for complete search history.

(56) References Cited

U.S. PATENT DOCUMENTS

| | | | | |
|---|---|---|---|---|
| 3,360,951 | A * | 1/1968 | Hoenisch | 62/137 |
| 5,164,606 | A * | 11/1992 | Secord | 250/577 |
| 6,082,130 | A | 7/2000 | Pastryk et al. | |
| 6,093,312 | A | 7/2000 | Boulter | |
| 6,148,624 | A | 11/2000 | Bishop | |
| 6,192,693 | B1 | 2/2001 | Kloppenberg | |
| 6,266,945 | B1 * | 7/2001 | Schroeder | 53/473 |
| 6,314,745 | B1 | 11/2001 | Janke et al. | |
| 6,351,958 | B1 * | 3/2002 | Pastryk et al. | 62/137 |
| 6,439,428 | B1 * | 8/2002 | Schroeder et al. | 222/64 |
| 6,442,954 | B1 * | 9/2002 | Shapiro et al. | 62/137 |
| 6,607,096 | B2 | 8/2003 | Glass et al. | |
| 7,188,479 | B2 | 3/2007 | Anselmino et al. | |
| 7,201,005 | B2 | 4/2007 | Voglewede et al. | |
| 2006/0150645 | A1 | 7/2006 | Leaver | |

FOREIGN PATENT DOCUMENTS

| | | |
|---|---|---|
| KR | 10-2005-0030673 | 3/2005 |
| KR | 10-2005-0110211 | 11/2005 |
| KR | 10-2005-0110211 A | 11/2005 |
| WO | WO 97/11325 | 3/1997 |

OTHER PUBLICATIONS

Korean Office Action dated Jun. 19, 2008, on Korean Application No. 10-2006-0137659, (4 pages).
Notice of Allowance issued in Korean Application No. 10-2006-137659, dated Mar. 24, 2009, 2 pages.
Korean Office Action dated Oct. 23, 2007, for Korean Application No. 10-2006-0137659, (4 pages).
Austrian International Search Report, dated Mar. 19, 2008 for Application No. PCT/KR2007/0006669 (7 pages).

* cited by examiner

*Primary Examiner*—Frantz F. Jules
*Assistant Examiner*—Cassey Bauer
(74) *Attorney, Agent, or Firm*—Fish & Richardson P.C.

(57) ABSTRACT

An ice supplier includes an ice maker configured to make ice, a case configured to store ice made by the ice maker, a sensing unit configured to sense a quantity of ice stored in the case, and a controller configured to control the ice maker according to a result of sensing from the sensing unit.

22 Claims, 10 Drawing Sheets

ICE SUPPLIER

This application claims the benefit of the Korean Patent Application No. 10-2006-0137659, filed on Dec. 29, 2006, which is hereby incorporated by reference as if fully set forth herein.

BACKGROUND

1. Field

The present disclosure relates to an ice supplier that may be used in a refrigerator to enable a user to control an ice storing quantity.

2. Discussion of the Related Art

An ice supplier is an appliance configured to make ice and supply the ice to a user. An ice supplier may be provided as an independent appliance or may be provided in a refrigerator, a freezer, or other appliances.

In one aspect, an ice supplier includes an ice maker configured to make ice, an ice storage bin configured to store ice made by the ice maker, and a sensing system configured to sense a quantity of ice stored in the ice storage bin. The sensing system includes a first sender positioned at a first height with respect to the ice storage bin and configured to send a first signal used in sensing the quantity of ice, a first receiver positioned at the first height with respect to the ice storage bin and configured to receive the first signal used in sensing the quantity of ice, a second sender positioned at a second height with respect to the ice storage bin and configured to send a second signal used in sensing the quantity of ice, the second height being different than the first height, and a second receiver positioned at the second height with respect to the ice storage bin and configured to receive the second signal used in sensing the quantity of ice. The ice supplier also includes a heating element arranged to be in thermal communication with and produce heat to defrost the first receiver and the second receiver, and a controller configured to control the ice maker based on the quantity of ice sensed by the sensing system.

Implementations may include one or more of the following features. For example, a first portion of the heating element positioned to be in thermal communication with and produce heat to defrost the first receiver may be connected to a second portion of the heating element positioned to be in thermal communication with and produce heat to defrost the second receiver. In another example, the first receiver may be positioned at the first height along a side of the ice storage bin, the second receiver may be positioned at the second height along the side of the ice storage bin, and the heating element may include a first portion positioned on the side of the ice storage bin proximate to the first receiver and a second portion positioned on the side of the ice storage bin proximate to the second receiver.

In some implementations, the heating element may be a first heating element, and the ice supplier may include a second heating element arranged to be in thermal communication with and produce heat to defrost the first sender and the second sender. In these implementations, the first receiver may be positioned at the first height along a first side of the ice storage bin, the second receiver may be positioned at the second height along the first side of the ice storage bin, and the first heating element may include a first portion positioned on the first side of the ice storage bin proximate to the first receiver and a second portion positioned on the first side of the ice storage bin proximate to the second receiver. The first sender may be positioned at the first height along a second side of the ice storage bin, the second side of the ice storage bin being opposite the first side of the ice storage bin, the second sender may be positioned at the second height along the second side of the ice storage bin, and the second heating element may include a first portion positioned on the second side of the ice storage bin proximate to the first sender and a second portion positioned on the second side of the ice storage bin proximate to the second sender. Further, in these implementations, the controller may be configured to control the first heating element and the second heating element to produce heat in response to detecting a signal at the first receiver or the second receiver that is less than a threshold.

In some examples, the sensing system may include a third sender positioned at a third height with respect to the ice storage bin and configured to send a third signal used in sensing the quantity of ice. The third height may be different than the first height and the second height. The sensing system also may include a third receiver positioned at the third height with respect to the ice storage bin and configured to receive the third signal used in sensing the quantity of ice. The first sender and first receiver may be positioned a predetermined distance from the second sender and second receiver and the third sender and third receiver may be positioned the predetermined distance from the second sender and second receiver.

The ice storage bin may include one or more walls defining a first cavity provided on a side of the ice storage bin at the first height and one or more walls defining a second cavity provided on a side of the ice storage bin at the second height. The first receiver may be positioned in the first cavity, and the second receiver may be positioned in the second cavity. The ice supplier may include a transparent member configured to cover the first cavity and the second cavity. The transparent member may include a first window configured to cover the first cavity and a second window configured to cover the second cavity.

In some implementations, the ice supplier includes an input device configured to receive user input indicating a desired quantity of ice to maintain in the ice storage bin. The controller may be configured to control the ice maker to maintain the desired quantity of ice in the ice storage bin based on the quantity of ice sensed by the sensing system. The ice supplier also may include a display device configured to render a user interface that displays a representation of the quantity of ice sensed by the sensing system.

The first signal and the second signal may be light signals. The first signal and the second signal may be Infrared signals.

In another aspect, a refrigerator includes a cabinet defining at least one compartment, a door configured to open or close the compartment, and an ice supplier installed in one of the compartment and the door. The ice supplier includes an ice maker configured to make ice, an ice storage bin configured to store ice made by the ice maker, and a sensing system configured to sense presence or absence of ice at multiple levels in the ice storage bin. The ice supplier also includes a user input device positioned on an outer surface of the door and configured to receive user input indicating a desired quantity of ice to maintain in the ice storage bin. The desired quantity of ice being related to one of the multiple levels in the ice storage bin. The ice supplier further includes a controller configured to control the ice maker to maintain the desired quantity of ice in the ice storage bin based on a result of sensing from the sensing system.

Implementations may include one or more of the following features. For example, the user input device may include a level selector configured to enable a user to increase or decrease a level of ice to maintain in the ice storage bin. The level of ice to maintain in the ice storage bin may be associated with one of the multiple levels. In this example, a number of levels included in the level selector may correspond to a number of levels at which the sensing system is configured to sense presence or absence of ice.

In some implementations, the user input device may be configured to enable a user to change a desired quantity of ice from a lower level associated with one of the multiple levels to a higher level associated with another one of the multiple levels, and the controller is configured to control the ice maker to produce ice until the sensing system senses presence of ice at the higher level.

The refrigerator may include a display device positioned on the outer surface of the refrigerator door and configured to render a user interface that displays a representation of the quantity of ice stored in the ice storage bin based on a result of sensing from the sensing system.

In yet another aspect, a refrigerator includes a cabinet defining at least one compartment, a door configured to open or close the compartment, an ice maker configured to make ice, an ice storage bin configured to store ice made by the ice maker, and a dispensing mechanism configured to transfer ice from the ice storage bin through the door. The refrigerator also includes a sensing system configured to sense a quantity of ice stored in the ice storage bin by sensing presence or absence of ice at multiple levels in the ice storage bin, a display device provided on an outer surface of the door, and a controller. The controller is configured to receive a signal from the sensing system indicating the quantity of ice stored in the ice storage bin, and control the display device to render a user interface including an indication of the quantity of ice stored in the ice storage bin and available for dispensing through the door based on the signal from the sensing system indicating the quantity of ice stored in the ice storage bin.

Implementations may include one or more of the following features. For example, the door may include an opaque portion that completely covers the ice storage bin such that the ice storage bin is not visibly perceivable through the door. The controller may be configured to control the display device to render a user interface that displays a graphic showing the quantity of ice in the ice storage bin. The graphic may be a graphic depicting a representation of the ice storage bin and a representation of the quantity of ice stored in the ice storage bin.

In some examples, the controller may be configured to control the display device to render a user interface that displays the quantity of ice in the ice storage bin as being empty, at a low level, at a medium level, or at a full level. The controller may be configured to control the display device to render a user interface that displays the quantity of ice in the ice storage bin as being at a level between an empty level and a full level.

DETAILED DESCRIPTION

Figure 1:
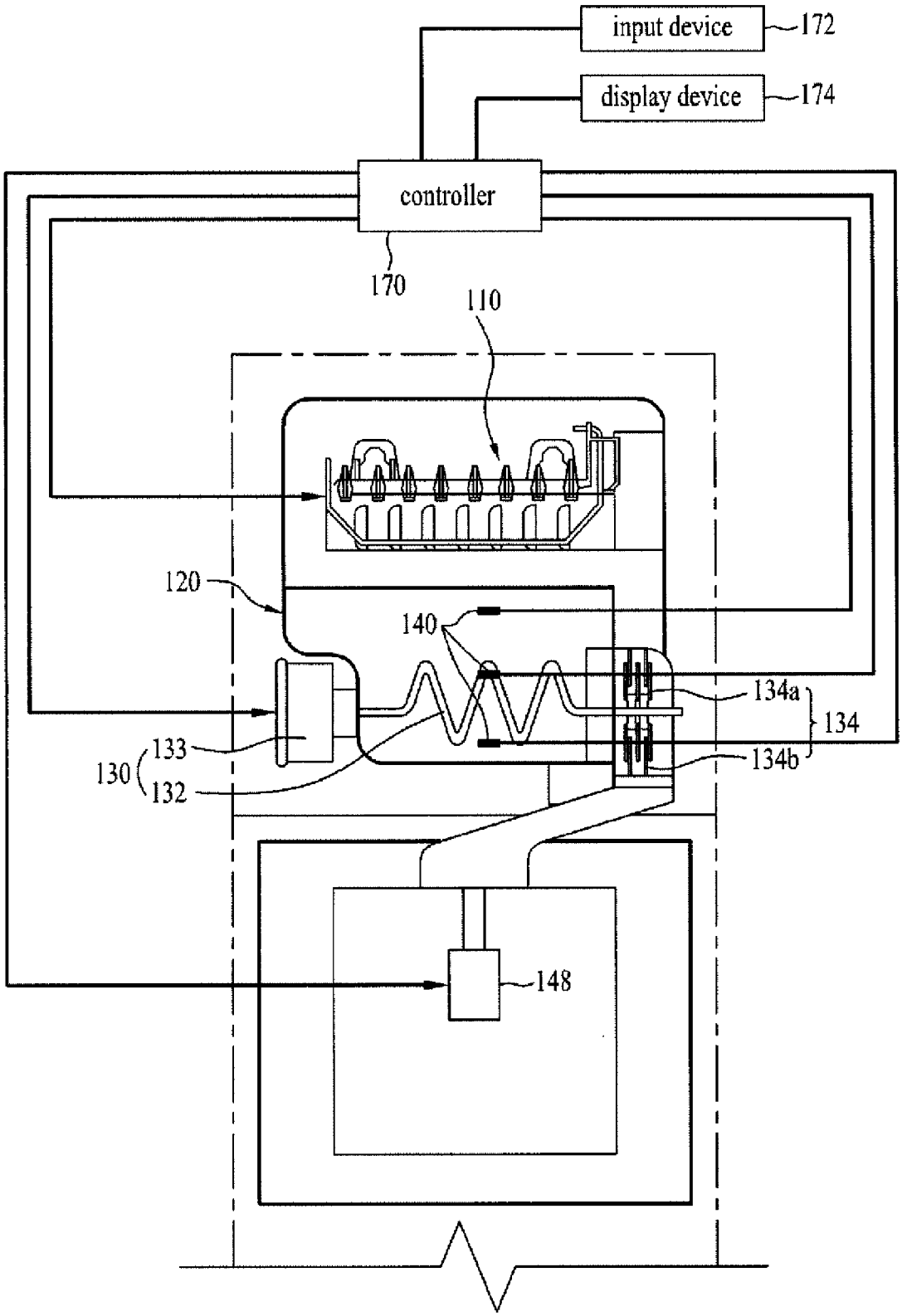
FIG. 1 illustrates an example of an ice supplier.

FIG. 1 illustrates an example of an ice supplier. As shown in FIG. 1, an ice supplier includes an ice maker 110 configured to make ice, a case or storage bin 120 configured to store ice made by the ice maker 110, a sensor 140 configured to sense a quantity of ice stored in the case 120, and a controller 170.

The ice supplier may be provided independently or may be provided in another appliance, for example, a refrigerator. In implementations in which the ice supplier is provided in a refrigerator, the ice supplier may be provided in a freezer portion or compartment of the refrigerator, or in a separate space of a refrigerating portion or compartment of the refrigerator. In the latter example, a temperature of the separate space in the refrigerating portion or compartment of the refrigerator may be regulated to a freezing temperature sufficient to make ice. In some implementations, the ice supplier may be provided in a door of the refrigerator. In other implementations, the ice supplier may be provided in a cabinet of the refrigerator and configured to communicate with a dispenser provided in a door of the refrigerator.

The case 120 may be provided with an opening at one side to receive ice made by the ice maker 110, and may be provided with an outlet at the other side to dispense ice stored in the case 120 through the outlet (e.g., dispense ice made by the ice maker 110 and received through the opening).

In some implementations, the ice supplier includes a transport mechanism 130 configured to move or transport ice stored within the case 120. The transport mechanism 130 may include a regulator 132 and a driving mechanism 133. The regulator 132 is configured to move ice stored in the case 120 to a dispenser, and the driving mechanism 133 is configured to drive the regulator 132.

The driving mechanism 133 may include a gear connected to a motor and configured to apply a driving force to the regulator in response to being driven (e.g., turned) by the motor. One end of the regulator 132 may be associated with the driving mechanism 133 such that force from the driving mechanism may be applied to the one end. The regulator 132 may be arranged at the base of the case 120 in a screw shape and may be configured to rotate along an axis of the driving mechanism 133 to move the ice within the case 120 to an outlet 124 of the case 120. The transport mechanism 130 may include additional or different components configured to move or transport ice stored in the case 120 to an outlet of the case 120.

In some implementations, a crusher 134 may be provided near an end of the regulator 132 to selectively crush ice moved by the regulator 132. The crusher 134 may be provided at an end of the regulator opposite of the transport mechanism 130 and positioned near the outlet of the case 120. In one example, the crusher 134 includes a fixed blade **134*b* and a rotary blade 134*a* and may be configured to dispense the ice moved by the regulator 132** in either a cubed or uncrushed form or in a crushed form depending on a user's selection.

The sensor 140 may include one or more sensing elements provided at one or more predetermined distances along the height of the case 120, so that the quantity of the ice stored in the case 120 may be sensed by the one or more sensing elements included in the sensor 140 at different heights. The sensor 140 will be described later in more detail with respect to FIGS. 5-8.

The controller 170 may be configured to control operation of the ice maker 120. For example, the controller 170 may control the ice maker 110 to produce additional ice if the sensor 140 senses that the quantity of ice stored in the case 120 is less than a set or desired storing quantity.

In some implementations, the ice supplier includes an input device 172 and a display device 174. The input device 172 may be configured to enable a user to provide user input to control operation of the ice supplier (e.g., provide user input to set a desired quantity of ice stored in the case 120) and the display device 174 may be configured to display status or properties of the ice supplier to the user (e.g., display the current setting for the desired quantity of ice).

The user may set the quantity of ice to be stored in the case 120 through manipulation of the input device 172, and verify or ascertain the set state by viewing the display device 174.

In some examples, the ice supplier may be controlled by another switching device. For example, as shown in FIG. 1, a switching device 148 associated with a dispenser may be configured to control the ice supplier.

In the example shown in FIG. 1, if a user pushes the switching device 148 (e.g., a lever) with a cup, ice is dispensed out. As a result of ice being dispensed out, the quantity of ice stored in the case 120 is reduced. The controller 170 is configured to allow the sensor 140 to sense the quantity of ice stored in the case 120 and control the ice maker 110 to produce additional ice if the quantity of ice is insufficient. The controller 170 may be configured to allow the sensor 140 to sense the quantity of ice stored in the case 120 continuously or may be configured to allow the sensor 140 to sense the quantity of ice stored in the case 120 only in response to detecting that ice has been dispensed (e.g., the quantity has likely been reduced). Sensing the quantity of ice stored in the case 120 only in response to detecting that ice has been dispensed may reduce power consumption of the ice supplier.

Although a lever is shown as the switching device 148 in FIG. 1, a sensing device may be provided to automatically sense that a user requests dispensing of ice. Alternatively, a button type switching device may be provided instead of the lever. Other input elements configured to control dispensing of ice may be used.

Figure 2:
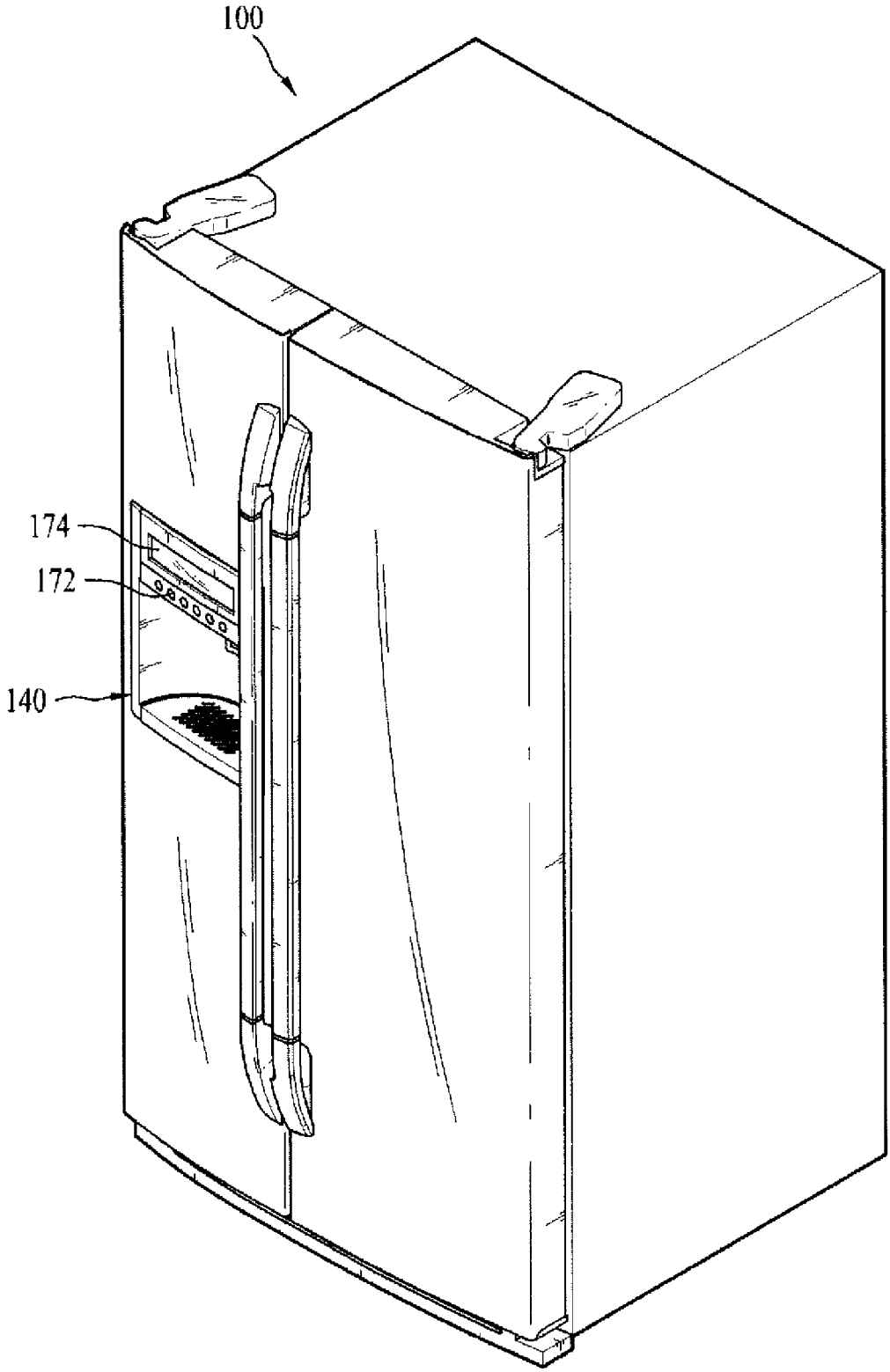
FIG. 2 illustrates an example of a refrigerator.

FIG. 2 illustrates an example of a refrigerator 100. The refrigerator 100 includes an ice supplier, such as the ice supplier described with respect to FIG. 1.

Although FIG. 2 illustrates that the ice supplier is provided in a door of the refrigerator, the ice supplier may be provided in other locations of the refrigerator 100. For example, the ice supplier may be provided inside the refrigerator 100 in a freezing compartment.

The refrigerator 100 includes the input device 172 and the display device 174 as described above with respect to FIG. 1. The input device 172 and the display device 174 may be part of the ice supplier or may be separate components. As shown in FIG. 2, the input device 172 and the display device 174 may be provided outside the refrigerator so that the user may easily access them.

Figure 3:
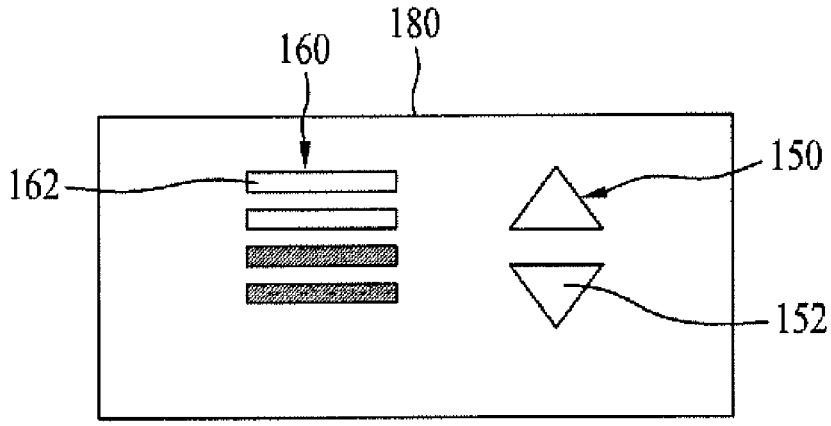
FIG. 3 illustrates an example of an input control device of a refrigerator or an ice supplier.
Figure 4:
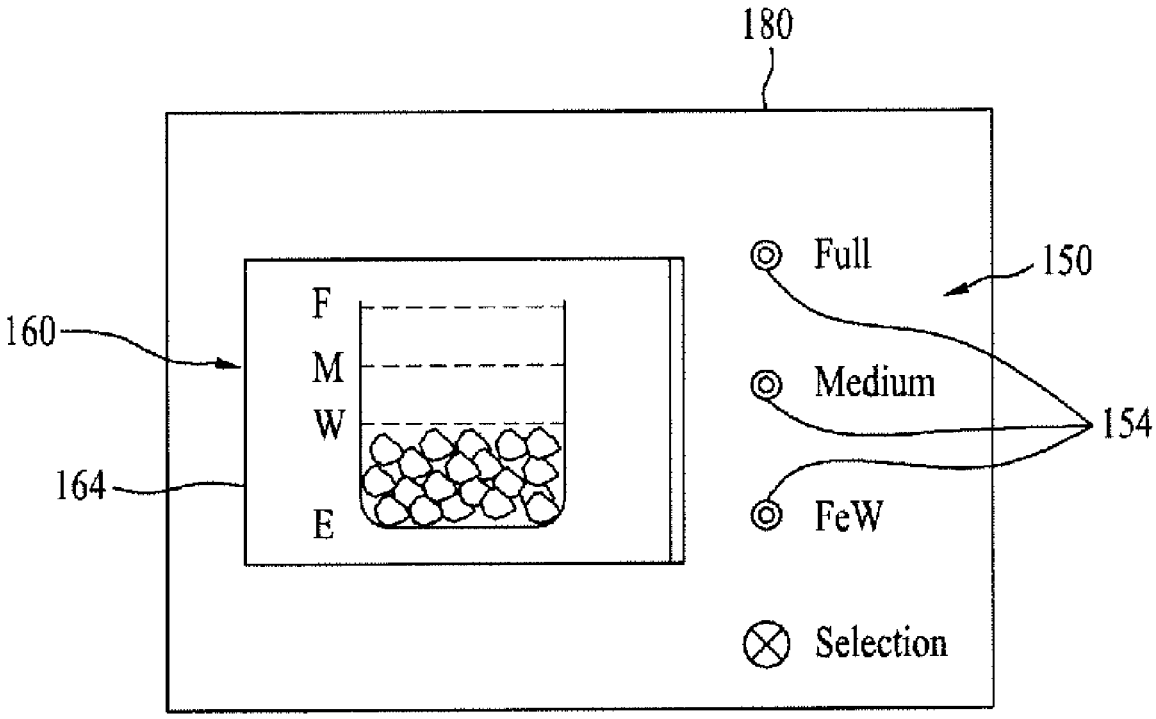
FIG. 4 illustrates another example of an input control device of a refrigerator or an ice supplier.

Referring to FIGS. 3 and 4, examples of an input control device 180 may include the input device 172 and the display device 174 described with respect to FIGS. 1 and 2 in a single device. In other examples, the input device 172 and the display device 174 may be provided separately.

As shown in FIGS. 3 and 4, the input control device 180 configured to control operation of the ice supplier includes an input part configured to enable a user to input information related to a quantity of ice the user desires to store in the case 120 of the ice supplier and a display part configured to display information related to a setting of a quantity of ice to store in the case 120 or information related to the quantity of ice currently stored in the case 120.

Referring to FIG. 3, a level operator is provided as the input part, and a level indication is provided as the display part. Referring to FIG. 4, a plurality of level selections is provided as the input part, and a display panel is provided as the display part.

As shown in FIG. 3, the level indication 160 is provided in such a manner that a plurality of indicators 162 are arranged at predetermined intervals to indicate the quantity of ice stored in the case 120. The level operator is configured to control illumination of the indicators 162 to provide an indication of the current setting for the desired quantity of ice.

The user may push the level operator indicated by an upward arrow 150 to increase the number of the indicators which are illuminated, thereby increasing the setting for the quantity of ice to store in the case 120. Alternatively, the user may push the level operator indicated by a downward arrow 152 to decrease the number of the indicators which are illuminated, thereby decreasing the setting for the quantity of ice to store in the case 120.

Referring to FIG. 4, three types of selections 154 for a quantity of ice to store in the case 120 may be provided. A different number of selections may be provided. For example, the number of selections may be based on the number of sensors or sensing elements included in the ice supplier and increase or decrease depending on the number of sensors or sensing elements provided.

As shown in FIG. 4, a user may select any one of three types of selections 154, i.e., few, medium, and full, so as to store a quantity of ice in the case 120 that is equivalent to the selected selection. Information of the selected selection may be displayed through the display panel.

For example, as shown in FIG. 4, a shape of a vessel which stores ice is displayed in the display panel 164. The vessel is divided into three parts to display an indication of a setting for the quantity of ice to store in the case 120 or an indication of the current quantity of ice in the case 120. The display panel 164 provides an indication of whether a setting of a quantity of ice to store (or the current quantity) is E(Empty), W(feW), M(Medium), or F(Full). In the example shown in FIG. 4, the setting for the quantity of ice to store is few and the display panel 164 displays the quantity of ice in the vessel as equivalent to W.

Figure 5:
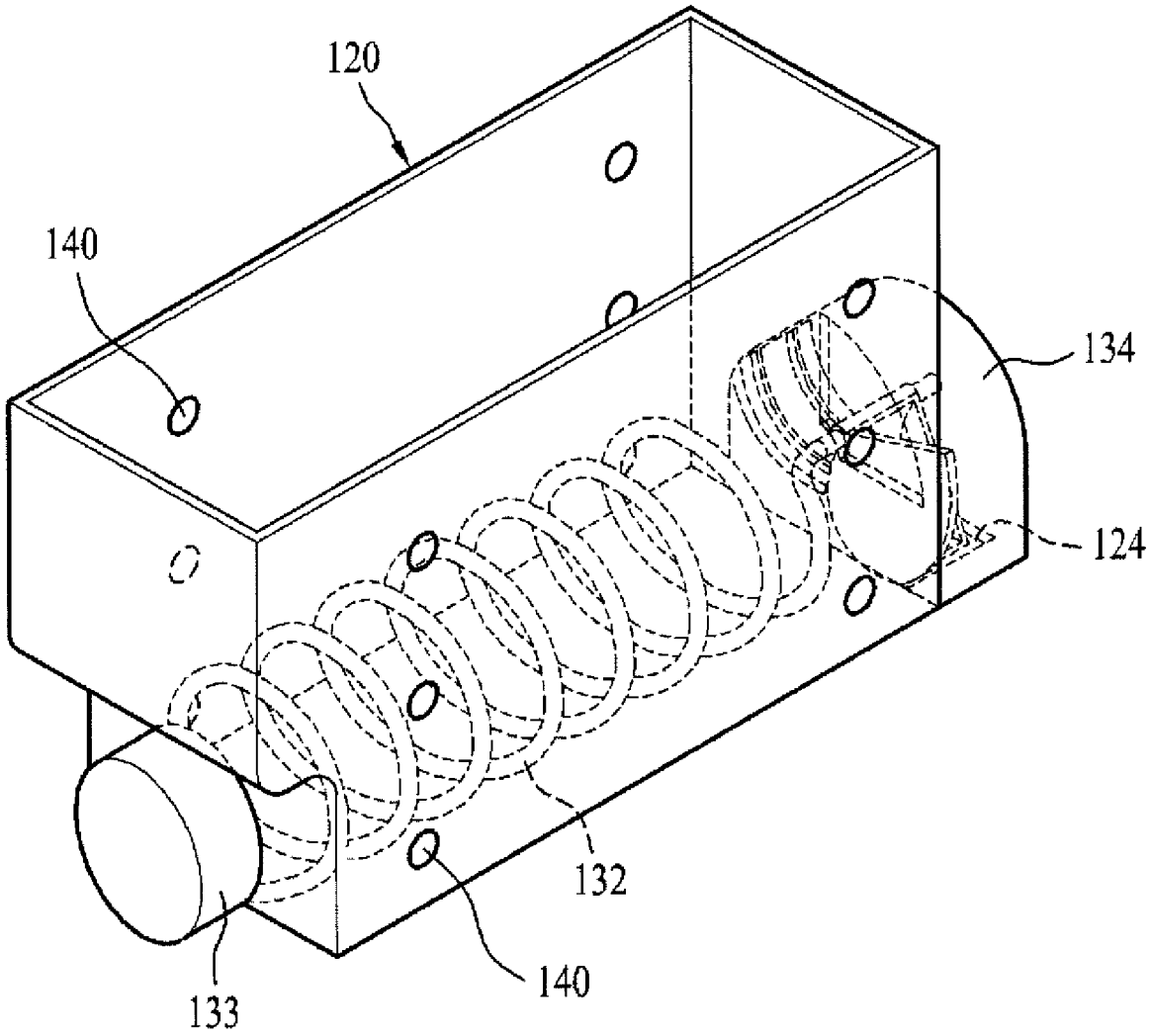
FIG. 5 illustrates an example of an ice transfer unit of an ice supplier.

FIG. 5 illustrates an example of an ice transfer unit of an ice supplier. As shown in FIG. 5, the sensor 140 includes a sending part at one side of the case 120 and a receiving part at the other side of the case 120. The receiving part is configured to receive a predetermined signal or light sent or emitted from the sending part.

The sending part includes a plurality of senders which are arranged at predetermined distances with predetermined spacing along the height of the case 120. The receiving part includes a plurality of receivers which are arranged at predetermined distances with predetermined spacing along the height of the case 120 to oppose the respective senders.

Each of the senders sends a predetermined signal or light to each of the receivers and each of the receivers receives or senses the predetermined signal or light to generate an on/off signal.

Although the respective senders and receivers may be arranged in two columns as shown in FIG. 5, they may be arranged in one column, or more than two columns. Providing more columns may increase the accuracy of the measurement across the case 120 to better account for stacking of ice in certain portions of the case 120.

The sending part and the receiving part may be provided in such a manner that the height of the case 120 is divided into several parts to measure whether ice exists in the parts. For example, three rows of respective senders and receivers at three different heights of the case 120 are shown in FIG. 5 to provide measurements at three heights or levels. Alternatively, the quantity of ice within the case 120 may linearly be measured.

Examples of the sensor 140 include an infrared (IR) sensor, a laser sensor, an ultrasonic sensor, and any other type of sensor configured to detect presence or absence of ice.

When the sensor 140 is an IR sensor, the sensor 140 includes one or more pairs of light-emitting parts and light-receiving parts. In implementations in which the sensor 140 is an IR sensor, the light-emitting part emits light and the light-receiving part receives the light emitted from the light-emitting part. The light-emitting part is provided at one sidewall of the case 120, and the light-receiving part is provided at the other sidewall of the case 120 at a height corresponding to a height of the light-emitting part.

Figure 6:
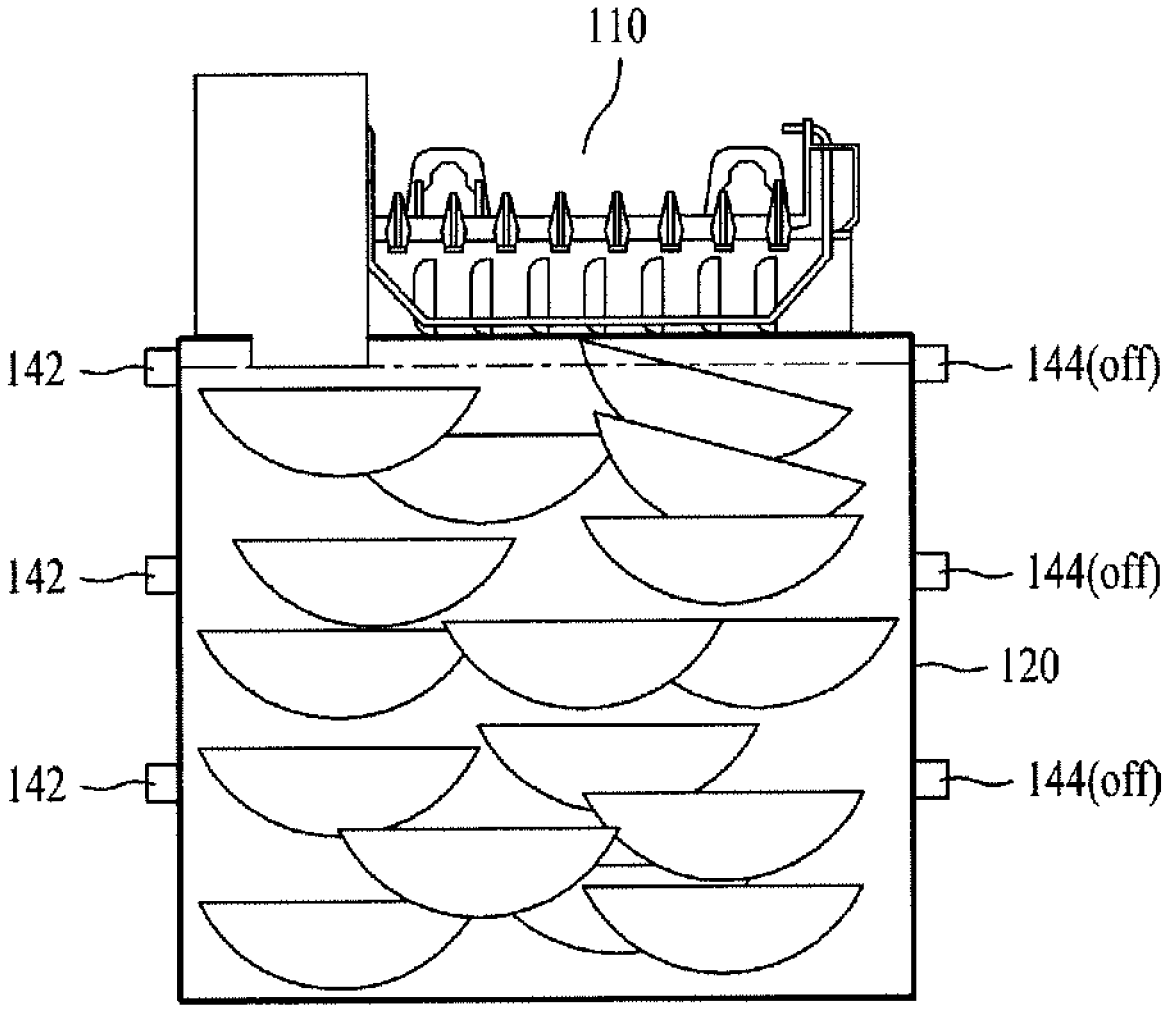
FIGS. 6 and 7 illustrate an example of a system configured to sense the quantity of ice included in a storage bin.
Figure 7:
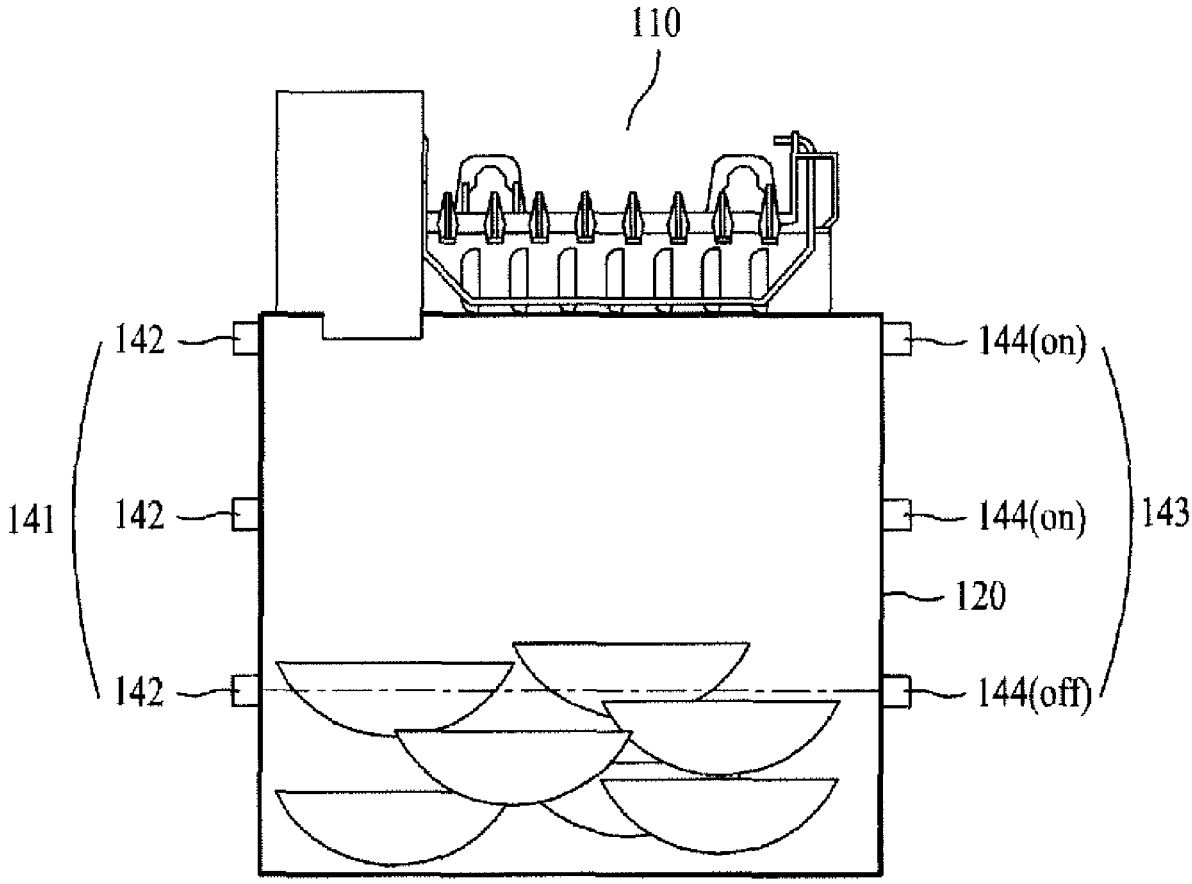

As shown in FIGS. 6 and 7, the height of the case 120 of the ice supplier may be divided into three parts so that the senders 142 and the receivers 144 are provided at the top of each part.

If the receiving part receives a signal or light sent from the sending part, the receiving part outputs an on signal. If not, the receiving part outputs an off signal.

The receiving part may not receive a signal or light sent from a sending part and outputs an off signal because the ice stored in the case 120 blocks, deflects, attenuates, or interferes with the signal or light sent from the sending part. The part where the off signal is generated corresponds to the height of the ice stored in the case 120. For example, because the height of the receivers 144 is known, the height of ice within the case may be determined based on which of the receivers outputs an off signal. In some implementations, the receiving part may output an off signal when a signal of lesser intensity is received.

FIG. 6 illustrates an example of when ice in the case 120 is full, and FIG. 7 illustrates an example of when the quantity of the ice is at the lowest level (e.g., ice is detected at the receiver positioned lowest within the case 120).

In other words, as shown in FIG. 6, all of the signals generated from the receivers 144 are off, indicating that the case 120 is full of ice. As shown in FIG. 7, signals from the two highest receivers 144 included in the receiving part 143 are on and a signal from the lowest receiver 144 is off indicating that ice in the case 120 is filled to a height above the lowest receiver and below the middle receiver. If the signals generated from the receivers 144 are all on signals, the controller 170 recognizes that the case 120 is empty of ice (e.g., filled to a level below the lowest receiver).

The structure of the sending part 141 and the receiving part 143 of the ice supplier is described in more detail with reference to FIG. 8.

Figure 8:
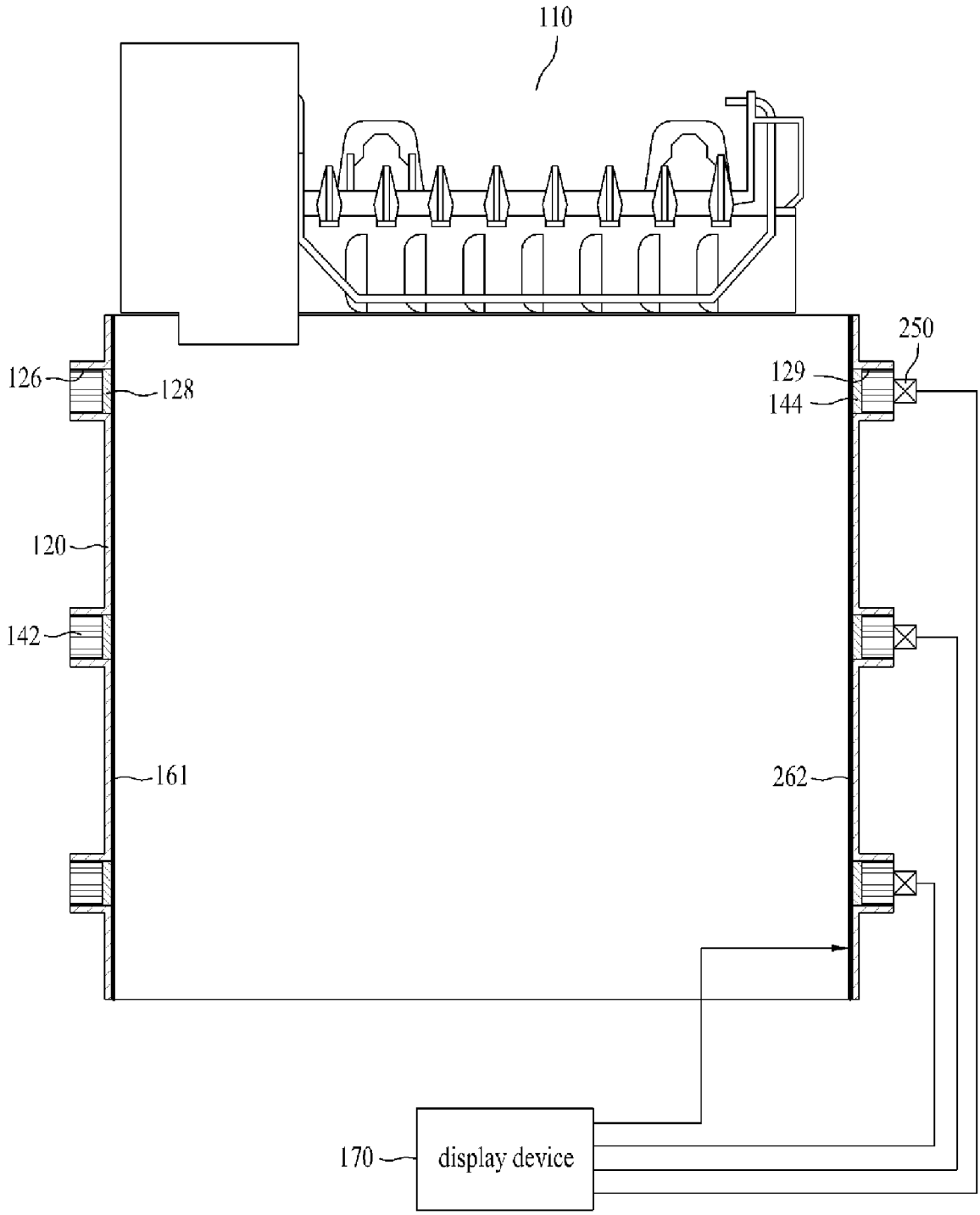
FIG. 8 illustrates an example of a sensor of an ice supplier.

FIG. 8 illustrates an example of a sensor of an ice supplier. The sending part 141 includes a plurality of cavities 126 provided on a side of the case 120. Each cavity is configured to accommodate a sender 142. A transparent member may cover each of the cavities on a side of the case 120 to enable the signal or light sent from each sender 142 to pass through the case 120.

As shown in FIG. 8, an example of the transparent member includes a plurality of windows 128. The plurality of windows 128 may be provided to cover each cavity. Alternatively, the plurality of cavities may be covered with one transparent member.

The receiving part 143 includes a plurality of cavities 129 provided on the other side of the case 120, i.e., the side which opposes the sending part 141. Each cavity 129 is configured to accommodate a receiver 144. A transparent member may cover each of the cavities on a side of the case 120 to enable the signal or light sent from the sender 142 to reach each receiver 144.

As shown in FIG. 8, an example of the transparent member includes a plurality of windows 130. The plurality of windows 130 may be provided to cover each cavity. Alternatively, the plurality of cavities may be covered with one transparent member.

One or more detectors 250 may be associated with the receivers 144. The detector 250 may be configured to detect a state of a receiver 144 and generate a signal corresponding to the state of the receiver 144. The signal generated by the detector 250 may be provided to the controller 170.

Because the sensor 140 is used in the ice supplier, the sensor 140 is subject to operation at a very low temperature. Operation at a low temperature may cause a temperature difference between heat generated from each sender 142 and each receiver 144 and a peripheral low temperature, whereby frost occurs in each sender 142 and each receiver 144 or each of the windows 128 and 130.

If frost occurs, an intensity of the signal or light emitted from the sender 142 may become weak and the signal or light received by the receiver 144 may also become weak. Consequently, performance of the sensor may be negatively impacted such that an off signal may improperly output from a receiver when ice is not filled to a level of the receiver.

Accordingly, the sending part 141 includes a first heating element 161 configured to defrost the senders 142, and the receiving part 143 includes a second heating element 262 configured to defrost the receivers 144.

Although FIG. 8 illustrates that each heating element is positioned to cover all the senders 142 and all the receivers 144, other arrangements may be used and multiple heating elements may be provided (e.g., one for each of the senders 142 and the receivers 144).

The controller 170 may be connected with each detector 250, the first heating member 161, and the second heating member 262. The controller 170 may be configured to control the heating element 161 and the heating element 262.

For example, the controller 170 detects a signal through each detector 250. If the intensity of the signal or light detected by the detector 250 becomes weak even in case of no dispensing of ice, the controller 170 turns on the first heating element 161 and the second heating element 262.

The signal or light transmitted between the senders 142 and receivers 144 may include any possible signal that is capable of detecting presence or absence of ice. For example, the signal may be an ultrasonic wave, infrared ray, or laser.

Figure 9:
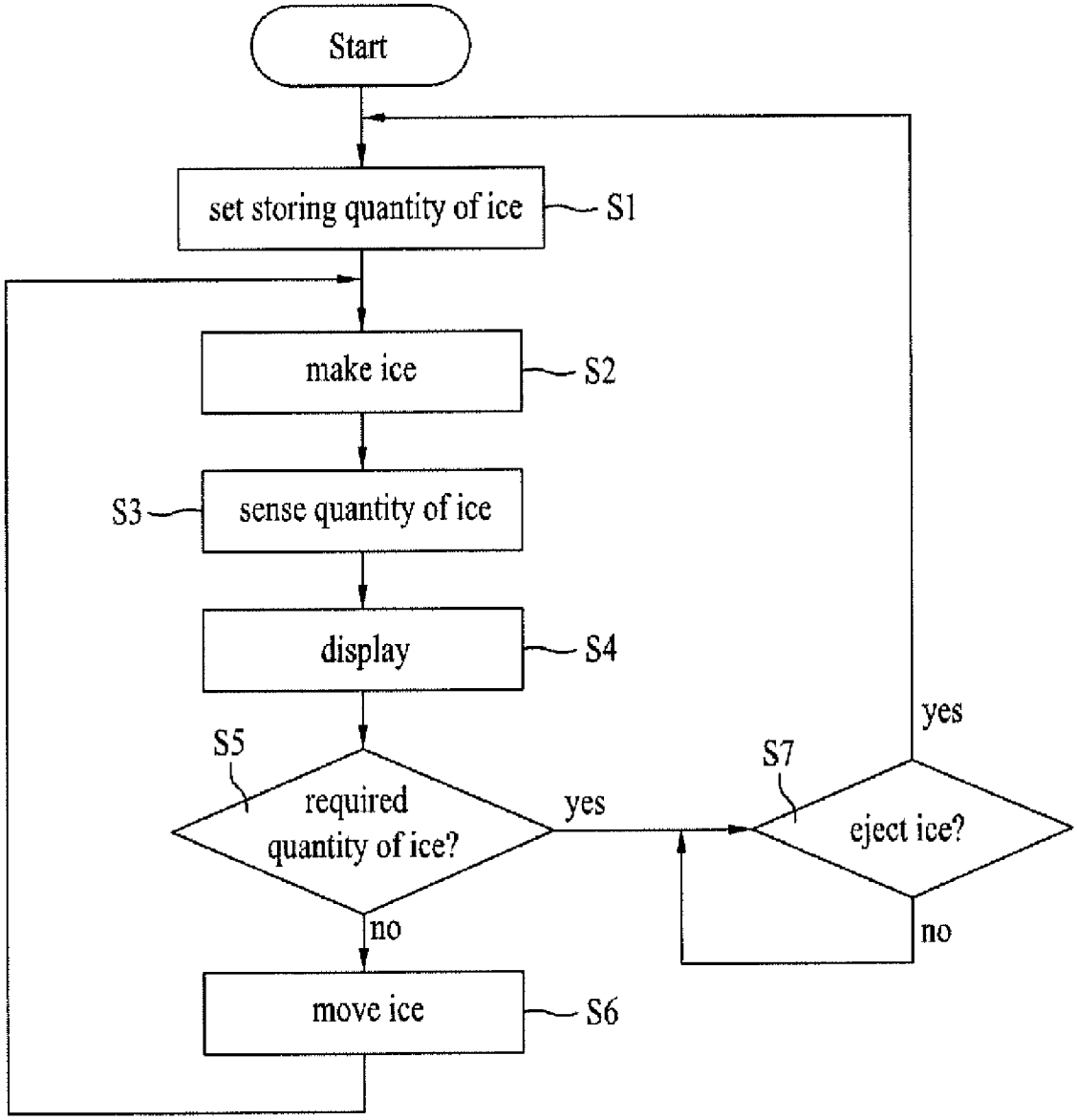
FIG. 9 is a flow chart illustrating an example of a process for sensing the quantity of ice of an ice supplier.

FIG. 9 illustrates an example of a process for sensing the quantity of ice of an ice supplier. For convenience, particular components described with respect to FIGS. 1-8 are referenced as performing the process. However, similar methodologies may be applied in other implementations where different components are used to define the structure of the system, or where the functionality is distributed differently among the components shown by FIGS. 1-8. The controller 170 sets a desired quantity of ice (S1). For example, the controller 170 may receive user input from the input control device 180 and set the quantity of ice based on the user input.

In some implementations, the controller 170 stores the set quantity in electronic storage and accesses the set quantity to control the ice maker 110.

The ice maker 110 makes ice (S2). For example, the ice maker 110 makes ice to store in the case 120. In some implementations, ice may be made before or after the quantity of ice has been set. For example, in one implementation, a user is required to set a quantity prior to the ice maker 110 making ice. In another example, the ice maker 110 makes ice according to a default quantity until a quantity is set. Setting the quantity may include changing or modifying a previously set quantity or a default quantity.

The sensor 140 measures the current quantity of ice within the case 120 (S3). For example, the sensor 140 may sense the quantity of ice and send a signal to the controller 170 for use in determining the quantity of ice.

After the current quantity of ice is measured, the controller 170 controls the display 174 or a display part of the input control device 180 to render a display of the current quantity of ice. The controller 170 compares the set quantity of ice input with the current quantity of ice measured through the sensor 140 (S5).

If the quantity of ice measured through the sensor 140 is less than the set quantity of ice, ice made by the ice maker 110 may be moved to the case 120 (S6). For example, the ice made by the ice maker 110 may be received in the case 120 for storage.

If the quantity of ice measured through the sensor 140 is greater than or equal to the set quantity of ice, the controller 170 initiates a standby mode without moving the ice made by the ice maker 110 to the case 120 (S7). For example, the ice maker 110 may be configured to hold a quantity of ice without moving it to the case 120. In this example, the ice maker 110 may be configured to hold the quantity ice that the ice maker 110 produces in one process of ice making.

The controller 170 maintains the standby mode until a user ejects ice, thereby causing a reduction in the quantity of ice stored in the case 120. If a user ejects ice, the quantity of ice within the case 120 changes, and the controller 170 repeats steps S2 through S5 until the quantity of ice in the case 120 is equal to or exceeds the set quantity. In some implementations, the controller 170 may determine whether the change in quantity of ice in the case 120 requires production of more ice. For example, the controller 170 may determine that the change in quantity is insignificant or too small to be detected by the sensor 140. In this example, the controller 170 may maintain the standby mode until further dispensing of ice causes a detectable change in the quantity of ice in the case 120.

The sensor 140 may measure the quantity of ice continuously or at any point needed and the controller 170 may control the display 174 or a display part of the input control device 180 to render a display of the current quantity of ice (or a setting of a desired quantity) continuously, when requested by a user, or at any point needed.

Because the user may control an ice storing quantity of the case 120 and change the set quantity to a quantity appropriate for a particular time or season, the user may typically obtain fresh ice. In some implementations, energy consumed to make and store unnecessary quantities of ice may be reduced. The user may be able to check the quantity of ice currently stored in the case 120 without viewing the case 120, thereby improving the user's convenience.

Figure 10:
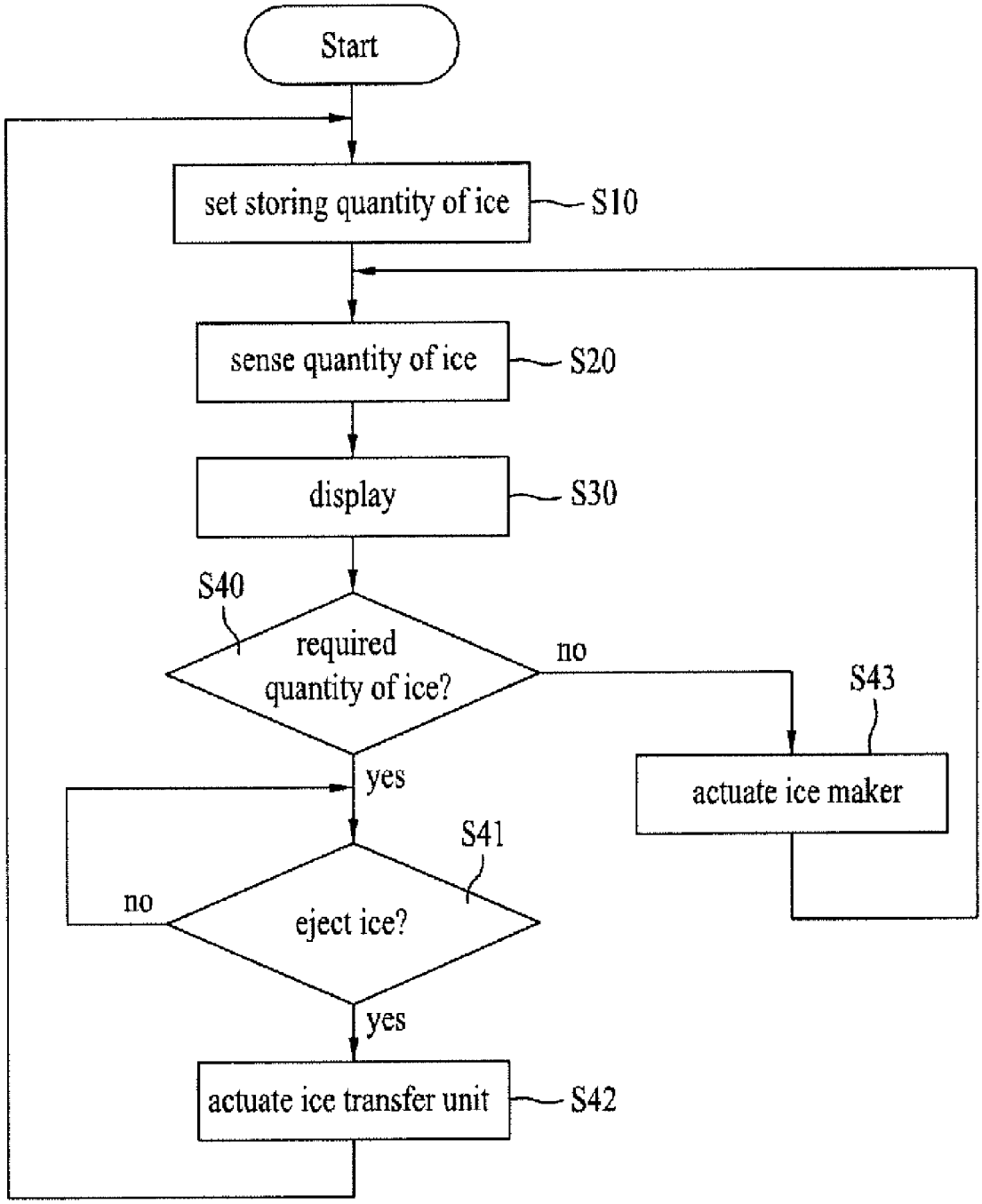
FIG. 10 is a flow chart illustrating another example of a process for sensing the quantity of ice of an ice supplier.

FIG. 10 is a flow chart illustrating another example of a process for sensing the quantity of ice of an ice supplier. For convenience, particular components described with respect to FIGS. 1-8 are referenced as performing the process. However, similar methodologies may be applied in other implementations where different components are used to define the structure of the system, or where the functionality is distributed differently among the components shown by FIGS. 1-8.

As shown in FIG. 10, the controller 170 sets a desired quantity of ice for storage in the case 120 based on input from a user (S10) and the controller 170 senses the storing quantity of ice to determine how much ice is stored in the case 120 (S20). The controller 170 displays the sensed result to the user through the display 174 or a display part of the input control device 180 (S30).

The controller 170 determines whether the sensed storing quantity of ice is equal to the set storing quantity of ice (S40). In other words, the controller determines whether the currently sensed quantity of ice has reached the set storing quantity of ice.

If the currently sensed quantity of ice has not reached the set storing quantity of ice, the controller actuates the ice maker 110 to supply ice (e.g., make and supply ice or move held ice previously made) into the case 120 (S43). If the currently sensed quantity of ice has reached the set storing quantity of ice, the controller determines whether a dispensing signal of ice exists (S41). If the dispensing signal of ice exists, the controller 170 actuates an ice transfer unit 130 to dispense the ice (S42).

If ice is dispensed, the control steps are performed until the quantity of ice in the case 120 reaches the set quantity of ice (e.g., the previous set quantity or a modified quantity set by a user).

Figure 11:
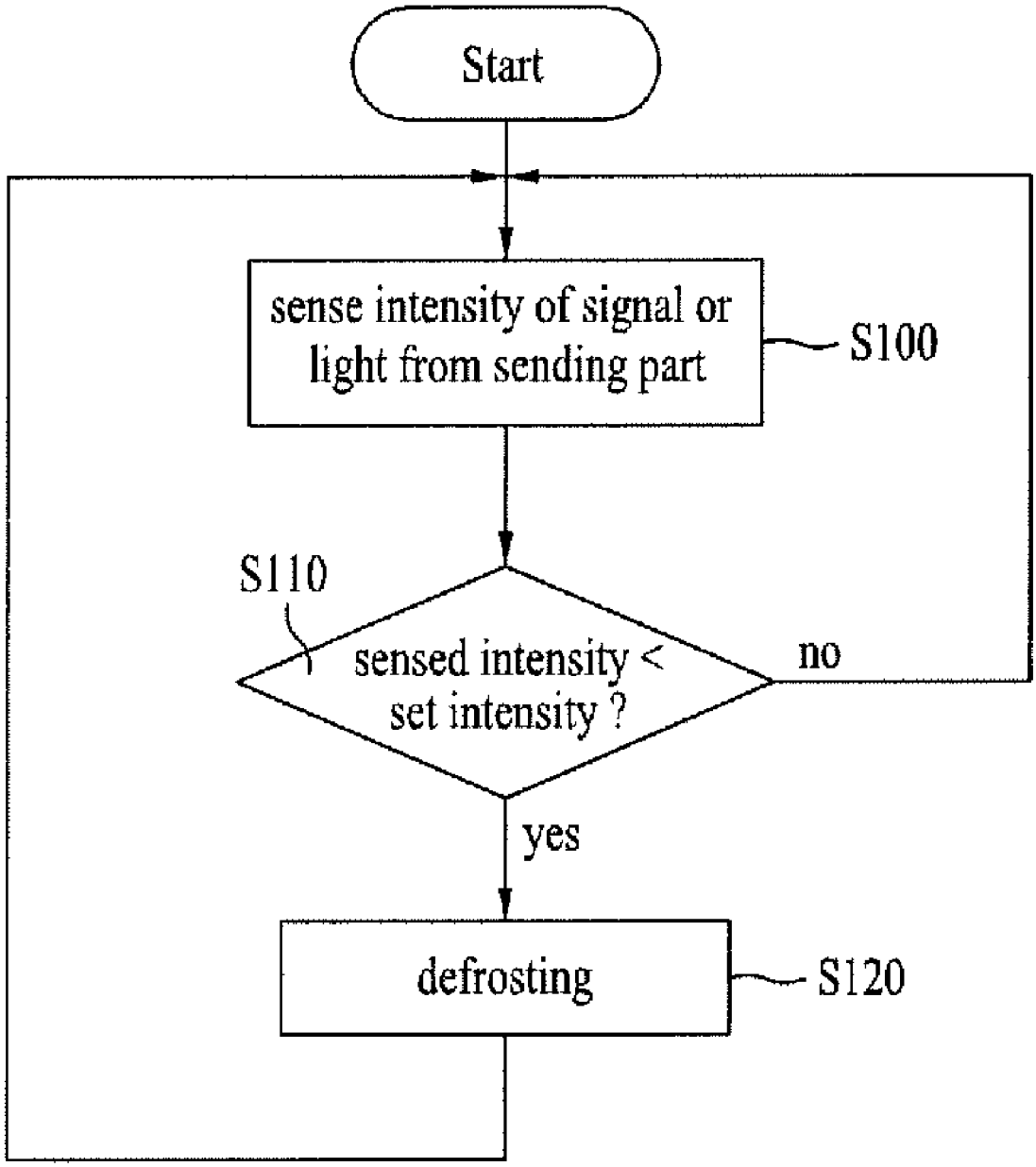
FIG. 11 is a flow chart illustrating an example of a process for defrosting sensing elements of an ice supplier.

FIG. 11 is a flow chart illustrating an example of a process for defrosting sensing elements of an ice supplier. For convenience, particular components described with respect to FIGS. 1-8 are referenced as performing the process. However, similar methodologies may be applied in other implementations where different components are used to define the structure of the system, or where the functionality is distributed differently among the components shown by FIGS. 1-8. As shown in FIG. 11, each detector 250 of the receiving part detects the intensity of the signal or light sent from the sending part (S100).

The controller compares the detected intensity with a known intensity (S110), and actuates the heating elements 161 and 262 to defrost the sensor if the detected intensity of the signal or light is less than the known intensity (S120). In some implementations, the known intensity may be a factory preset intensity that the sensor should be able to achieve. In other implementations, the known intensity may be a previous intensity measured by the detector 250 and the controller 170 may be able to detect changes in the measured intensity. The defrosting process (e.g., turning on the heating elements 161 and 262) may be performed until the controller 170 determines that a detected intensity is equal to or greater than the known intensity or an intensity needed to properly detect presence or absence of ice.

In some examples, when the controller 170 detects that the sensor 140 needs to be defrosted, actuation of the ice maker 110 may be stopped until the sensor 140 is defrosted.

In other examples, the ice maker 110 may continue to be actuated while the sensor 140 is defrosted. In this example, because the quantity of ice stored in the case 120 may not be detected, the ice maker 110 may use another device to determine when the case 120 is full, may make ice for a set amount of time based on the previously detected quantity of ice, may control ice making based on dispensing commands received from a user and the amount of ice the ice maker has made (e.g., infer quantity), or may provide no control over ice making.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An ice supplier comprising:

an ice maker configured to make ice;

an ice storage bin configured to store ice made by the ice maker, a sensing system configured to sense a quantity of ice stored in the ice storage bin, the sensing system including:

a first sender positioned at a first height with respect to the ice storage bin and configured to send a first signal used in sensing the quantity of ice;

a first receiver positioned at the first height with respect to the ice storage bin and configured to receive the first signal used in sensing the quantity of ice;

a second sender positioned at a second height with respect to the ice storage bin and configured to send a second signal used in sensing the quantity of ice, the second height being different than the first height;

a second receiver positioned at the second height with respect to the ice storage bin and configured to receive the second signal used in sensing the quantity of ice;

a heating element arranged to be in thermal communication with and produce heat to defrost the first receiver and the second receiver;

wherein the heating element comprises a single heat generating portion that is in thermal communication with both the first receiver and the second receiver and that produces heat to defrost both the first receiver and the second receiver;

wherein the single heat generating portion abuts a surface of the first receiver through which the first signal is received and abuts a surface of the second receiver through which the second signal is received; and a controller configured to control the ice maker based on the quantity of ice sensed by the sensing system.

2. The ice supplier as claimed in claim 1, wherein a first portion of the heating element positioned to be in thermal communication with and produce heat to defrost the first receiver is connected to a second portion of the heating element positioned to be in thermal communication with and produce heat to defrost the second receiver.

3. The ice supplier as claimed in claim 1, wherein:

the first receiver is positioned at the first height along a side of the ice storage bin, the second receiver is positioned at the second height along the side of the ice storage bin, and the heating element includes a first portion positioned on the side of the ice storage bin proximate to the first receiver and a second portion positioned on the side of the ice storage bin proximate to the second receiver.

4. The ice supplier as claimed in claim 1, wherein the heating element is a first heating element, further comprising:

a second heating element arranged to be in thermal communication with and produce heat to defrost the first sender and the second sender.

5. The ice supplier as claimed in claim 4, wherein:

the first receiver is positioned at the first height along a first side of the ice storage bin, the second receiver is positioned at the second height along the first side of the ice storage bin, the first heating element includes a first portion positioned on the first side of the ice storage bin proximate to the first receiver and a second portion positioned on the first side of the ice storage bin proximate to the second receiver, the first sender is positioned at the first height along a second side of the ice storage bin, the second side of the ice storage bin being opposite the first side of the ice storage bin, the second sender is positioned at the second height along the second side of the ice storage bin, and the second heating element includes a first portion positioned on the second side of the ice storage bin proximate to the first sender and a second portion positioned on the second side of the ice storage bin proximate to the second sender.

6. The ice supplier as claimed in claim 5, wherein the controller is configured to control the first heating element and the second heating element to produce heat in response to detecting a signal at the first receiver or the second receiver that is less than a threshold.

7. The ice supplier as claimed in claim 1, wherein the sensing system further comprises:

a third sender positioned at a third height with respect to the ice storage bin and configured to send a third signal used in sensing the quantity of ice, the third height being different than the first height and the second height; and a third receiver positioned at the third height with respect to the ice storage bin and configured to receive the third signal used in sensing the quantity of ice, wherein the first sender and first receiver are positioned a predetermined distance from the second sender and second receiver and the third sender and third receiver are positioned the predetermined distance from the second sender and second receiver.

8. The ice supplier as claimed in claim 1, wherein:

the ice storage bin includes one or more walls defining a first cavity provided on a side of the ice storage bin at the first height and one or more walls defining a second cavity provided on a side of the ice storage bin at the second height, the first receiver is positioned in the first cavity, and the second receiver is positioned in the second cavity.

9. The ice supplier as claimed in claim 8, further comprising:

a transparent member configured to cover the first cavity and the second cavity.

10. The ice supplier as claimed in claim 9, wherein the transparent member comprises a first window configured to cover the first cavity and a second window configured to cover the second cavity.

11. The ice supplier as claimed in claim 1, further comprising an input device configured to receive user input indicating a desired quantity of ice to maintain in the ice storage bin, wherein the controller is configured to control the ice maker to maintain the desired quantity of ice in the ice storage bin based on the quantity of ice sensed by the sensing system.

12. The ice supplier as claimed in claim 1, further comprising a display device configured to render a user interface that displays a representation of the quantity of ice sensed by the sensing system.

13. The ice supplier as claimed in claim 1, wherein the first signal and the second signal are light signals.

14. The ice supplier as claimed in claim 1, wherein the first signal and the second signal are Infrared signals.

15. The ice supplier as claimed in claim 1, wherein the single heat generating portion is positioned to extend between the first receiver and the second receiver.

16. The ice supplier as claimed in claim 1, further comprising a display device that is positioned on an exterior of a door of an appliance housing the ice supplier and that is configured to, based on the quantity of ice sensed by the sensing system, render a display of a current quantity of ice stored in the ice storage bin using at least four quantity levels, thereby enabling a user to check the quantity of ice currently stored in the ice storage bin without having to open the door of the appliance and view the ice storage bin.

17. An ice supplier comprising:

an ice maker configured to make ice;

an ice storage bin configured to store ice made by the ice maker;

a sensing system configured to sense a quantity of ice stored in the ice storage bin, the sensing system including:

a first sender positioned at a first height with respect to the ice storage bin and configured to send a first signal used in sensing the quantity of ice;

a first receiver positioned at the first height with respect to the ice storage bin and configured to receive the first signal used in sensing the quantity of ice;

a second sender positioned at a second height with respect to the ice storage bin and configured to send a second signal used in sensing the quantity of ice, the second height being different than the first height;

a second receiver positioned at the second height with respect to the ice storage bin and configured to receive the second signal used in sensing the quantity of ice;

a third sender positioned at a third height with respect to the ice storage bin and configured to send a third signal used in sensing the quantity of ice, the third height being different than the first height and the second height;

a third receiver positioned at the third height with respect to the ice storage bin and configured to receive the third signal used in sensing the quantity of ice;

a heating element arranged to be in thermal communication with and produce heat to defrost the first receiver and the second receiver;

a controller configured to control the ice maker based on the quantity of ice sensed by the sensing system;

wherein the heating element comprises a single heat generating portion that is in thermal communication with all of the first receiver, the second receiver, and the third receiver and that produces heat to defrost all of the first receiver, the second receiver, and the third receiver;

wherein the single heat generating portion abuts a surface of the first receiver through which the first signal is received, abuts a surface of the second receiver through which the second signal is received, and abuts a surface of the third receiver through which the third signal is received; and a display device that is positioned on an exterior of a door of an appliance housing the ice supplier and that is configured to, based on the quantity of ice sensed by the sensing.

18. The ice supplier as claimed in claim 17, wherein the display device is configured to render a display of a current quantity of ice stored in the ice storage bin by indicating one of a first quantity level, a second quantity level, a third quantity level, and a fourth quantity level, the second quantity level being greater than the first quantity level, the third quantity level being greater than the second quantity level, and the fourth quantity level being greater than the third quantity level.

19. The ice supplier as claimed in claim 17, wherein the single heat generating portion is positioned to extend between all of the first receiver, the second receiver, and the third receiver.

20. The ice supplier as claimed in claim 17, further comprising an input device that is positioned on the exterior of the door of the appliance housing the ice supplier and that is configured to receive user input selecting one of at least four quantity levels of ice to maintain in the ice storage bin, wherein the controller is configured to control the ice maker to maintain the selected quantity level of ice in the ice storage bin based on the quantity of ice sensed by the sensing system.

21. The ice supplier as claimed in claim 17, wherein the first signal, the second signal, and the third signal are light signals.

22. The ice supplier as claimed in claim 17, wherein the first signal, the second signal, and the third signal are Infrared signals.

* * * * *